US005893753A

United States Patent [19]

Hempel, Jr.

[11] Patent Number: 5,893,753

[45] Date of Patent: Apr. 13, 1999

[54] VIBRATING POLISHING PAD CONDITIONING SYSTEM AND METHOD

[75] Inventor: Eugene O. Hempel, Jr., Sunnyvale, Calif.

[73] Assignee: Texas Instruments Incorporated, Dallas, Tex.

[21] Appl. No.: 08/869,619

[22] Filed: Jun. 5, 1997

[51] Int. Cl.[6] ..... B08B 7/00

[52] U.S. Cl. ..... 438/691; 438/693; 134/33; 134/198; 156/345; 216/89

[58] Field of Search ..... 438/691, 692, 438/693, 959, 906; 134/33, 34, 198; 156/345 LP, 345 LS; 216/38, 88, 89

[56] References Cited

U.S. PATENT DOCUMENTS

| | | | |
|---|---|---|---|
| 5,522,965 | 6/1996 | Chisholm et al. | 216/89 X |
| 5,531,861 | 7/1996 | Yu et al. | 216/89 X |
| 5,578,529 | 11/1996 | Mullins | 438/692 |
| 5,597,443 | 1/1997 | Hempel | 438/693 |
| 5,702,563 | 12/1997 | Salugsugan et al. | 438/693 |

*Primary Examiner*—William Powell
*Attorney, Agent, or Firm*—W. James Brady, III; Richard L. Donaldson

[57] ABSTRACT

A system and method for conditioning a polishing pad in a chemical-mechanical polishing process for polishing a semiconductor device. In one aspect, a vibrating conditioning device 20 removes slurry build-up, such a slurry glaze and slurry impregnation, on the polishing pad 10 surface to enhance the polishing pad effectiveness. The vibrating conditioning device 20 includes a vibrating mechanism 30 coupled to a pad conditioning device, such as a conventional pad conditioning disk, to vibrate the pad conditioning device 20 during the conditioning operation. In another aspect, a high pressure spray device 12 removes particles from the polishing pad 10 surface to reduce damage to a semiconductor device during chemical-mechanical polishing. The high pressure spray device 12 includes a tube 22 formed to include a plurality of delivery holes 32 through which a pressurized substance is delivered onto the polishing pad 10 surface.

20 Claims, 3 Drawing Sheets

VIBRATING POLISHING PAD CONDITIONING SYSTEM AND METHOD

TECHNICAL FIELD OF THE INVENTION

The present invention relates to semiconductor device processing and, more particularly, to a system and method for conditioning a semiconductor wafer polishing pad that includes a vibrating conditioning device and a high pressure spray.

BACKGROUND OF THE INVENTION

Advances in electronic devices generally include reducing the size of the components that form integrated circuits. With smaller circuit components, the value of each unit area of a semiconductor wafer becomes higher. The planarization, contaminant count, and general uniformity of a semiconductor wafer become critical to achieving this reduction in size of integrated circuits and enhancing the performance of these integrated circuit devices.

In order to planarize a semiconductor wafer and to remove particle contaminants, many wafer manufacturer employ chemical mechanical polishing ("CMP") processes. CMP systems place a semiconductor wafer in contact with a polishing pad that rotates relative to the semiconductor wafer. The CMP process will reduce voids in the wafer, increase the flatness of the wafer, and generally will enhance the performance of the integrated circuit. To enhance the effectiveness and the life of the polishing pad, CMP systems typically employ a conditioning disk to condition the polishing pad. The conditioning disk will contact the polishing pad surface to condition the polishing pad to enhance the planarization of the polishing pad. Conventional pad conditioning systems typically dispense a slurry onto the polishing pad prior to the conditioning disk contacting the polishing pad. These conventional pad conditioning systems have several limitations.

One problem associated with conventional pad conditioning using conditioning disks involves particle damage to the wafer. The conditioning disk removes a relatively small layer of the polishing pad to condition the polishing pad. The particles removed from the polishing pad can contact the wafer during polishing and scratch or otherwise damage the wafer.

The conditioning disks can provide another source of particulate generation. The conditioning disks used in conventional pad conditioning systems typically have an abrasive surface. The particles from this abrasive surface, such as the diamonds and nickel used in diamond impregnated disks, can break away from disk onto the polishing pad during conditioning. This can lead to scratches on the wafer surface during wafer polishing that damage the wafer.

The slurry used in the polishing pad conditioning process can also cause problems. The slurry can contaminate voids in the polishing pad surface or impregnate into the polishing pad surface. The slurry can also create a glaze over the polishing pad surface. Both of these slurry-related problems can reduce the polishing pad's effectiveness, which in turn, can reduce the uniformity of the wafer. The slurry may also provide a source of particle contamination that can damage the wafer during polishing.

SUMMARY OF THE INVENTION

The present invention provides a polishing pad conditioning system and method that substantially eliminates or reduces disadvantages and problems associated with previously developed polishing pad conditioning systems and methods.

More specifically, the present invention provides a system for conditioning a polishing pad in a chemical-mechanical polishing process that removes particles and slurry that have accumulated on the polishing pad prior to polishing the wafer.

In one embodiment, the conditioning system includes a vibrating conditioning device to remove slurry build-up, such a slurry glaze and slurry impregnation on the polishing pad surface, to enhance the polishing pad effectiveness. The vibrating conditioning device includes a vibrating mechanism coupled to a pad conditioning device, such as a conventional pad conditioning disk. The vibrating mechanism operates to vibrate the pad conditioning device during the conditioning operation.

In another embodiment, the present invention uses a high pressure spray to remove particles from the polishing pad surface during a chemical-mechanical polishing process. The high pressure spray device includes a tube formed to include a plurality of delivery holes through which a pressurized substance is delivered to the polishing pad surface.

The present invention can combine the vibrating conditioning pad and the high pressure spray device to provide a further increased ability to remove particles and slurry from the polishing pad resulting in a more uniform wafer with a reduced likelihood of particle damage after polishing.

The present invention provides an important technical advantage by reducing or eliminating damage to a semiconductor device, such as a wafer, during polishing caused by particles on the polishing pad. The present invention can remove particles on the polishing pad that have been generated during polishing from the conditioning pad, from the polishing pad, or from the slurry. Removing particles from the polishing pad will reduce or eliminate scratches and other particle-related damage to the wafer during the CMP process.

The present invention provides another technical advantage by eliminating or greatly reducing slurry glaze build-up on the polishing pad to enhance the effectiveness of the wafer polishing.

The present invention also provides a technical advantage by extending the polishing pad life.

BRIEF DESCRIPTION OF THE DRAWINGS

For a more complete understanding of the present invention and the advantages thereof, reference is now made to the following description taken in conjunction with the accompanying drawings in which like reference numerals indicate like features and wherein.

DETAILED DESCRIPTION OF THE INVENTION

Preferred embodiments of the present invention are illustrated in the figures like numerals being used to refer to like and corresponding parts of the various drawings.

The present invention can provide enhanced conditioning of a polishing pad during a CMP process. In one embodiment, the present invention uses a vibrating conditioning device for conditioning the polishing pad prior to polishing a semiconductor wafer. The vibration of the conditioning device enhances the conditioning device's ability to remove particles embedded in and slurry glazed on the polishing pad surface to enhance the usefulness of the polishing pad. In another embodiment, the present invention provides a high pressure deionized water spray to spray the polishing pad during CMP to remove slurry particles, polishing pad particles, and conditioning device particles generated during polishing. Removal of particles on the polishing pad surface reduces the likelihood of damage to the wafer during polishing due to particles on the polishing pad scratching the wafer. The use of high pressure deionized water spray in conjunction with the vibrating pad conditioner device can reduce damage to wafers due to particles on the polishing pad, increase wafer uniformity after CMP processing, and extend the polishing pad life.

Figure 1:
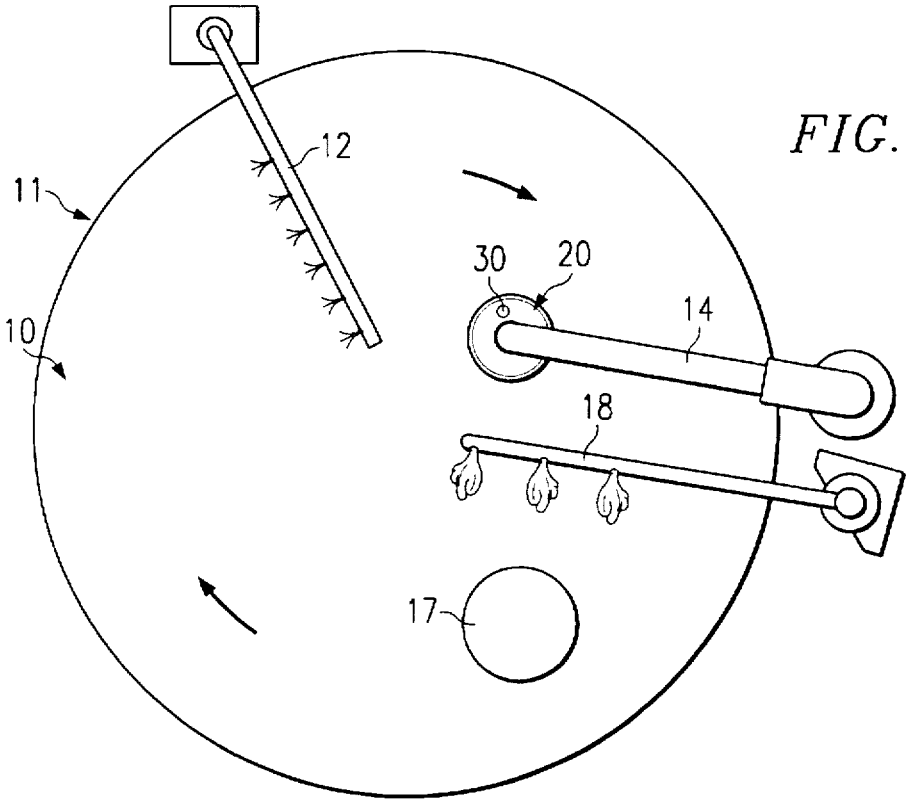
FIG. 1 shows a CMP system including embodiments of the present invention.

FIG. 1 illustrates a CMP system 100 that includes polishing pad 10 coupled to polishing platen 11, and slurry dispenser 18. Pad conditioner 14 includes vibrating pad conditioning device 20 that further includes a vibration mechanism 30 coupled to the pad conditioning device 20. The pad conditioning device 20 can include a grit pad conditioning disk, a diamond impregnated pad conditioning disk, or a stainless steel pad conditioning disk. Vibration mechanism 30 can include a transducer or other device capable of vibrating pad conditioning device 20 during operation. FIG. 1 also shows high pressure spray device 12 operable to deliver a pressurized substance onto polishing pad 10 during operation to remove particles on polishing pad 10. The present invention can use deionized water as the substance delivered under high pressure to the polishing pad 10. Deionized water is an appropriate substance because it is unlikely to introduce any more particles onto polishing pad 10 during operation. Ammonia hydroxide, or a mixture of deionized water and ammonia hydroxide, could also be used as an injection substance. Different substances could be delivered onto the polishing pad 10 based on the type of slurry dispensed in the CMP process.

Figure 2A:
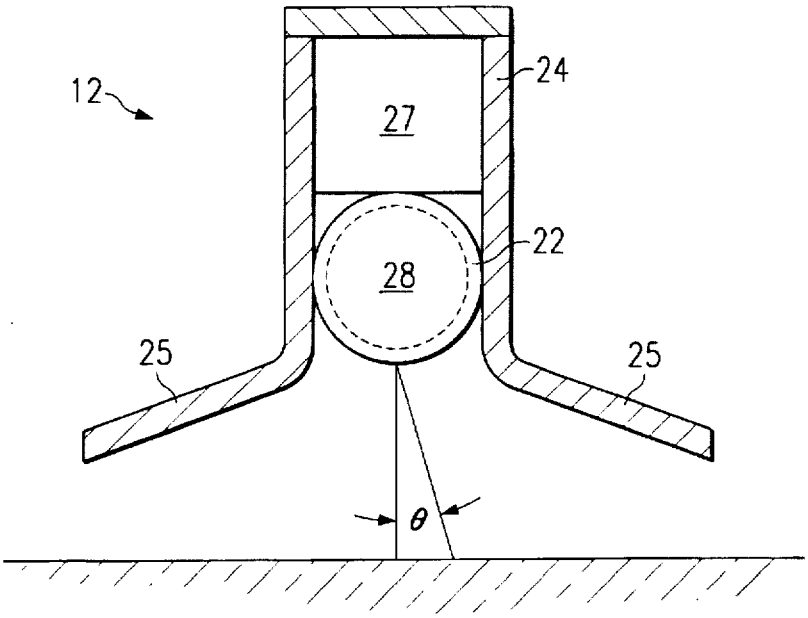
FIG. 2A shows a front view of one embodiment of the high pressure spray device of the present invention.
Figure 2B:
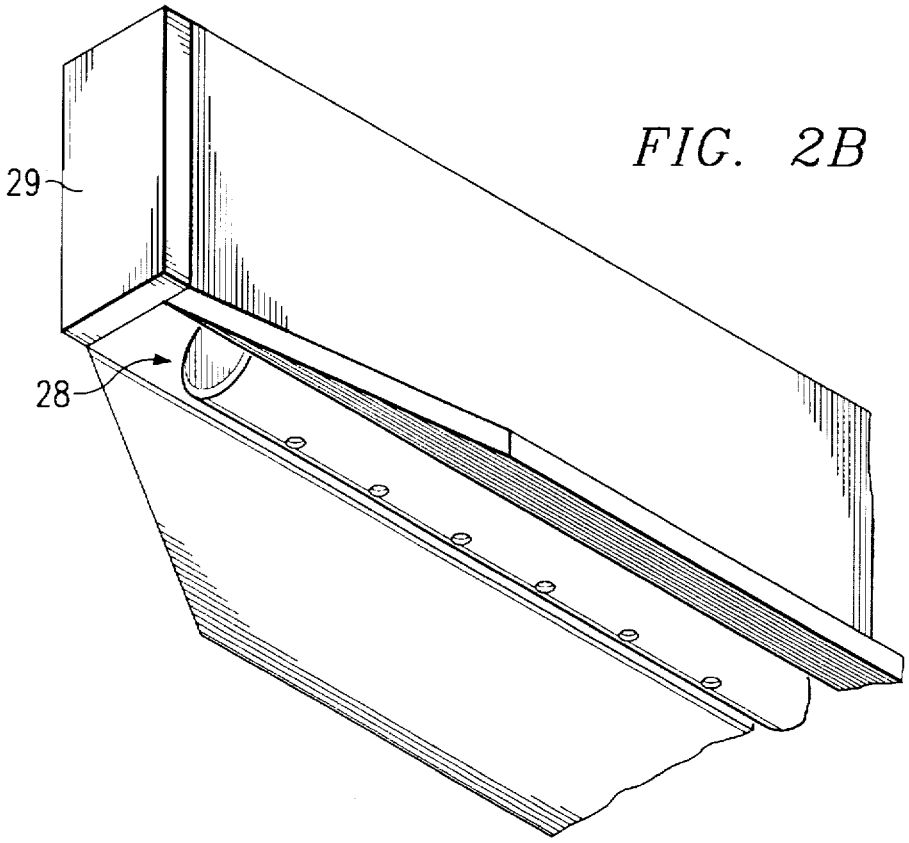
FIG. 2B shows a perspective view of the embodiment of the high pressure spray device of FIG. 2A.

FIG. 2A shows one embodiment of the high pressure spray device 12 of the present invention including high pressure spray tube 22 surrounded by shroud 24. Shroud 24 can include flared sides 25 to provide increased splash guard protection during operation. Shroud 24 can be constructed from a plastic (such as lexan) or metal (such as stainless steel) material. Shroud 24 can cover high pressure spray tube 22 from the capped end 28 to the last of the delivery holes 32 or further back to the open end 26 of high pressure spray tube 22. High pressure spray device 12 can also include front cover 29, coupled to shroud 24 as shown in FIG. 2B, for covering the front of shroud 24. Alternatively, shroud 24 can include front cover 29 as an integral part.

Figure 3:
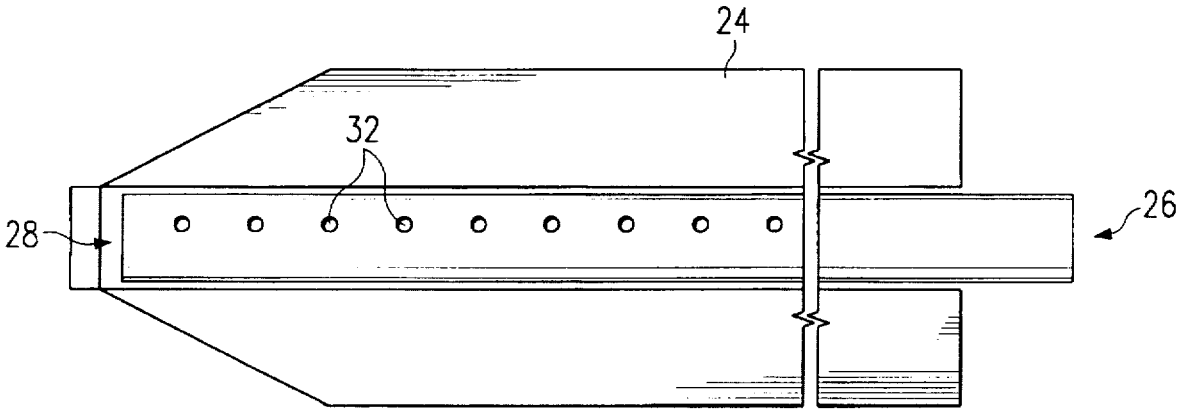
FIG. 3 shows a bottom view of the embodiment of the high pressure spray device of FIG. 2A.

High pressure tube 22, shown in greater detail in FIG. 3, includes a plurality of delivery holes 32 through which the deionized water exits during operation. Each of the delivery holes 32 can have a diameter of approximately 0.025 inches. In an alternative embodiment, high pressure tube 22 could comprise a double wall tube having an outer wall and an inner wall, with the deionized water flowing between the inner and outer walls, with the plurality of delivery holes 32 penetrating the outer wall. High pressure spray tube 22 can be constructed from stainless steel or other material not adversely affected by deionized water or similar substance. To achieve a deionized water approach angle θ relative to polishing pad 10, high pressure spray tube 22 can be positioned so that the plurality of delivery holes 32 can be offset from the tube bottom centerline as shown in FIG. 3 (showing a bottom view of high pressure spray tube 22). High pressure spray tube 22 has an open first end 26 that couples to a deionized water supply, and a capped second end 28. High pressure spray tube 22 can have a diameter of approximately ⅛ of an inch and any length that will allow the plurality of delivery holes 32 to deliver deionized water over the entire area a wafer can travel (the wafer polish track) over polishing pad 10. The plurality of deliver holes 32 can be spaced approximately 0.160 of an inch apart along high pressure spray tube 22 beginning approximately ¾ of an inch from capped end 28 as far along high pressure spray tube 22 as necessary to give spray coverage of the entire wafer polish track 17.

High pressure spray device 12 can also include a mechanism to prevent high pressure spray tube 22 from moving away from polishing pad 10 during operation in reaction to the force from flowing deionized water through delivery holes 32. As shown in FIG. 2A, high pressure spray device 12 can include spacer 27 between shroud 24 and high pressure spray tube 22 that contacts both shroud 24 and high pressure spray tube 22 during operation to prevent high pressure spray tube 22 from moving upward, or "jumping," during operation. Spacer 27 can be a single solid spacer or can include a plurality of spacers placed along the length of the high pressure spray tube 22.

FIG. 1 also shows vibrating pad conditioning device 20 with vibrating mechanism 30 coupled to the top portion of conditioning device 20. In a typical CMP system, a pad conditioning device 20 moves along pad conditioning arm 14 within pad conditioning arm slot (not shown) across polishing pad 10 during operation. Pad conditioning disks, such as the TWB conditioning disk 42 shown in FIG. 4, have a limited range of movement, both horizontally and vertically. The present invention takes advantage of this limited range of movement by coupling a vibrating mechanism 30, an example of which is a transducer, to the pad conditioning disk 42 in order to move (vibrate) the pad conditioning disk during operation.

Vibrating mechanism 30 shown in FIG. 1 is a 150 watt transducer coupled to the outside of a conditioning device 20. Vibrating mechanism 30 can include transducers with higher or lower outputs. Transducer 30 can couple to conditioning disk 20, for example, by means of an epoxy, a screw, or a contact and bracket mounting system.

Figure 4:
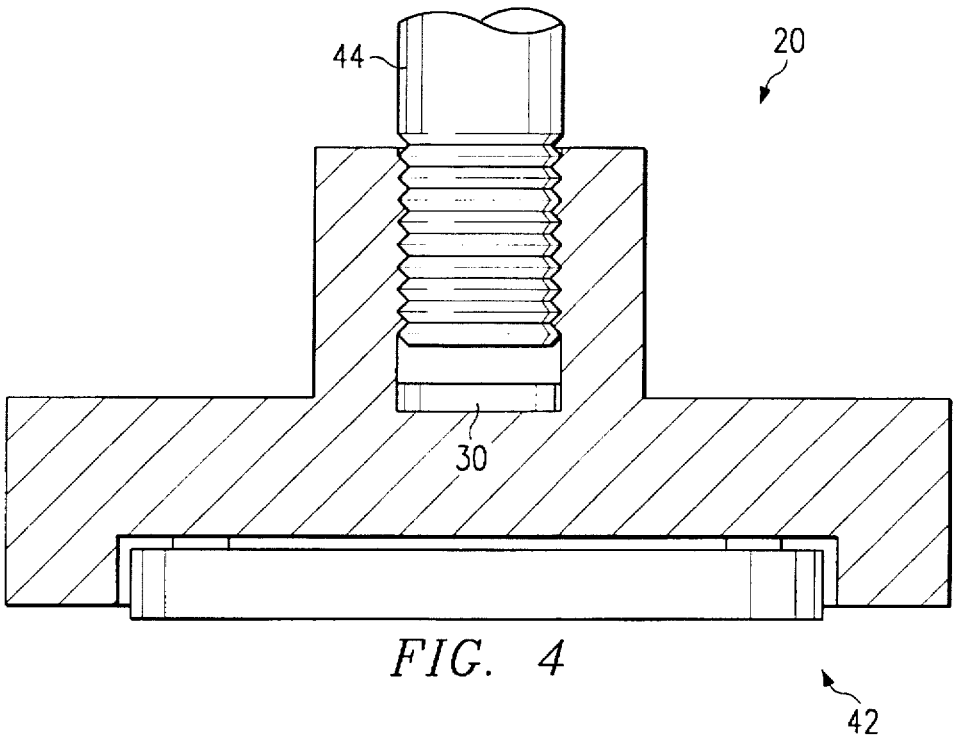
FIG. 4 shows a cut-away side view of another embodiment of the vibrating pad conditioning device of the present invention.

FIG. 4 shows a side cut-away view of an alternative embodiment of the vibrating pad conditioner 20 having the transducer 30 mounted internally within conditioning disk 42. Arm assembly 44 couples conditioning disk 42 to pad conditioning arm 14 (not shown). Transducer 30 can mount in a recess formed below arm assembly 44 Arm assembly 44 can couple to conditioning disk 42 by means of a flex coupling 46 that allows conditioning disk 42 limited movement in the horizontal and vertical directions. The transducer mounting arrangement shown in FIG. 4 allows the transducer 30, or other vibrating mechanism 30, to be located near the radial center of the conditioning disk 42. This center mounting can provide a more uniform vibration of the vibrating pad conditioner 20 due to a more balanced weight and force distribution.

Figure 5:
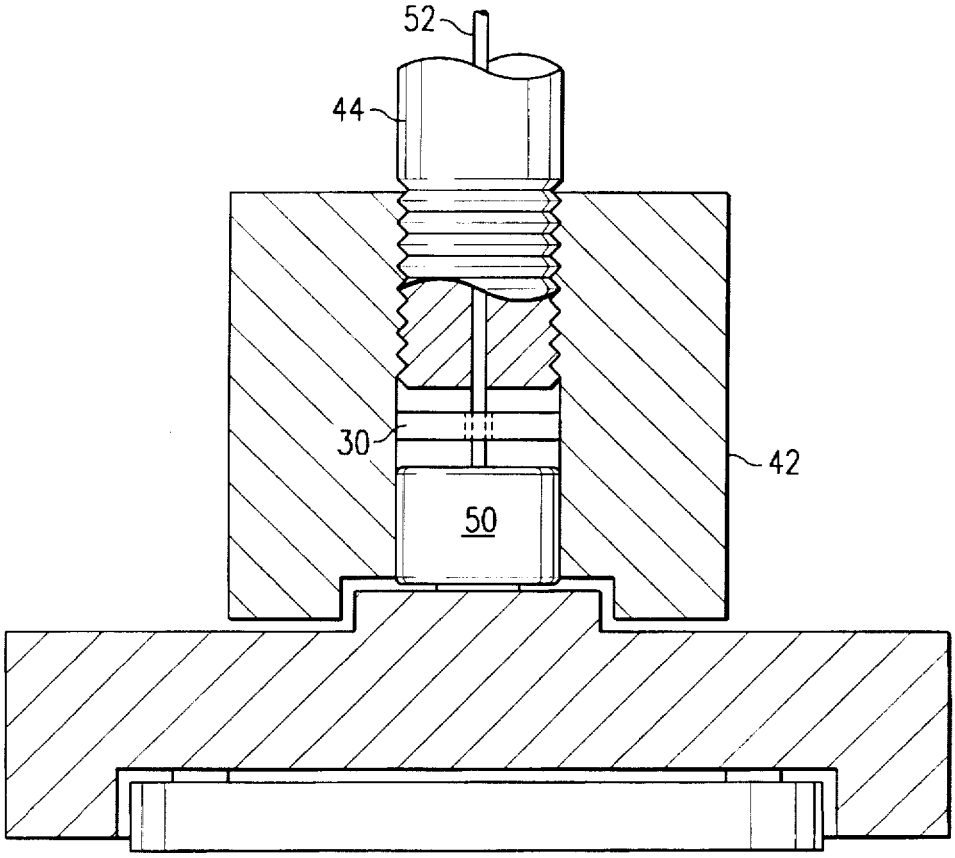
FIG. 5 shows a cut-away side view of another embodiment of the vibrating pad conditioning device of the present invention.

FIG. 5 shows a side cut-away view of another alternative embodiment of the vibrating pad conditioner 20. The embodiment of FIG. 5 includes a rotating motor 50 mounted in a recess formed within conditioning disk 42. The internally mounted rotating motor 50 can be connected by electrical connection 52 to an electrical source (not shown). During operation, the rotating motor 50 rotates the conditioning disk 42, while the transducer 30 vibrates the conditioning disk 42. The resulting vibrating/rotating pad conditioning device 20 can have an increased effectiveness in removing slurry glaze on, and slurry particles impregnated in, polishing pad 10.

During pad conditioning, polishing platen 11 and polishing pad 10 rotate as a unit as indicated in FIG. 1. As polishing platen 11 and polishing pad 10 rotate, slurry applicator 18 applies slurry to polishing pad 10. As polishing pad 10 continues to rotate, the portion of polishing pad 10 that just received slurry comes in contact with vibrating pad conditioning device 20. Energizing the vibrating mechanism 30 causes the pad conditioning device 20 to vibrate during operation. Pad conditioning device 20 moves along pad conditioning arm 14, within a slot contained in pad conditioning arm 14. The contact between the vibrating conditioning device 20 and the polishing pad 10 conditions polishing pad 10 by removing a very small layer of polishing pad 10. Immediately thereafter, the conditioned portion of polishing pad 10 comes in contact with a semiconductor wafer (not shown) traveling on wafer polish track 17. Polishing pad 10 then polishes the semiconductor wafer. During the polishing process, slurry can impregnate into voids of polishing pad 10. Furthermore, the heat and rotation involved in the polishing process can cause the slurry to glaze onto polishing pad 10. Both of these types of slurry build-up on the polishing pad can limit the effectiveness of polishing pad 10, reduce wafer uniformity, and potentially increase damage to the polished wafer. Immediately after polishing the semiconductor wafer, the portion of polishing pad 10 having most recently contacted the semiconductor wafer again contacts vibrating pad conditioning device 20 for reconditioning During the reconditioning, the vibration of the vibrating pad conditioner will act to remove slurry that has glazed onto polishing pad 10 during the polishing cycle. The vibrating conditioning device 20 of the present invention also removes slurry particles embedded into the polishing pad. This allows the pad conditioner to work more efficiently thus reducing the amount of time to condition the pad.

After a wafer has completed polishing and has moved to the next position, high pressure spray device 12 can operate to remove particles on the polishing pad 10 surface. The erosion of both the polishing pad 10 and the conditioning device 20 during pad conditioning can contribute to the particle count on the polishing pad 10. Furthermore, the slurry contains particles that can also accumulate and contact the wafer.

Deionized water can be flowed into the high pressure tube 22 at approximately one hundred pounds per square inch (psi) to create a high pressure flow. The pressure can range from less than 90 psi to greater than 120 psi for the embodiment described in FIGS. 2 and 3. Even wider pressure ranges can be used for different diameter high pressure tubes 22 and different diameter delivery holes 32. The deionized water then flows through smaller diameter delivery holes 32 to contact the rotating polishing pad 10. The deionized water is delivered onto polishing pad 10 such that the deionized water leaves the high pressure tube at an angle few degrees greater than ninety (into the rotation direction of polishing pad 10) to strike the polishing pad 10 at a slight angle against the rotation of polishing pad 10, as shown in FIG. 2A. This angular spray direction can increase the particulate removal force applied by the high pressure spray onto polishing pad 10. The high pressure deionized water is injected onto polishing pad 10 for an adequate period of time to allow the high pressure spray to contact the entire polishing pad polish surface (typically one to two seconds for polishing pads rotating at 30 to 50 revolutions per minute). During operation, shroud 24 acts as a water container to prevent excessive water splashing onto polishing pad 10. Shroud 24 acts to prevent excessive migration of the deionized water. The operation of the high pressure spray device 20 can be done automatically, or alternatively, can be performed manually.

The centrifugal force of the rotating polishing pad 10 will force the deionized water, and the particles collected in that deionized water, off the edge of polishing pad 10. The deionized water used for injection onto polishing pad 10 can include deionized water heated to approximately 100 to 180 degree Fahrenheit. The high pressure spray wash will remove particles on the polishing pad that have accumulated due to erosion of the polishing pad during conditioning, erosion of the conditioning disk during conditioning, and particles generated by the slurry.

Upon conclusion of the high pressure spray wash, the slurry is then dispensed onto polishing pad 10 prior to polishing another wafer. The dispensing of slurry should occur such that the wafer contacts slurry and not residual water on polishing pad 10.

The use of the vibrating pad conditioning device 20 in combination with the high pressure spray device 12 will remove particles and slurry build up on the polishing pad that damage wafers and decreases the effectiveness of the polishing pad. Vibrating pad conditioning device 20 will first remove slurry glaze and slurry impregnated in the polishing pad. The high pressure spray device 12 will then remove particles generated from the polishing and conditioning steps (including particles generated by the vibrating pad conditioning device 20) from the surface of polishing pad 10. In addition to reducing damage to wafers, the use of the vibrating pad conditioning device 20 in conjunction with the high pressure spray device 12 can reduce the time required to condition a polishing pad. For example, the present invention could reduce total conditioning time from approximately 2 seconds per polishing pad segment for conventional pad conditioning systems to approximately 0.5 seconds per polishing pad segment In summary, the present invention provides a system and method for conditioning a polishing pad in a chemical-mechanical polishing process. In one aspect, a vibrating conditioning device removes slurry build-up, such a slurry glaze and slurry impregnation, on the polishing pad surface to enhance the polishing pad effectiveness. The vibrating conditioning device includes a vibrating mechanism coupled to a pad conditioning device, such as a conventional pad conditioning disk, to vibrate the pad conditioning device during the conditioning operation. In another aspect, a high pressure spray removes particles from the polishing pad surface to reduce damage to a semiconductor device during chemical-mechanical polishing. The high pressure spray device includes a tube formed to include a plurality of delivery holes through which a pressurized substance is delivered onto the polishing pad surface.

Although the present invention has been described in detail, it should be understood that various changes, substitutions and alterations can be made hereto without departing from the spirit and scope of the invention as described by the appended claims.

What is claimed is:

1. A system for conditioning a polishing pad in a chemical-mechanical polishing process, comprising:

a vibrating pad conditioning device operable to remove slurry build-up on the polishing pad, thereby enhancing the polishing effectiveness of the polishing pad when polishing a semiconductor device, the vibrating pad conditioning device comprising;

a pad conditioning device, the pad conditioning device operable to contact a polishing pad when the polishing pad is rotating; and a vibration mechanism coupled to the conditioning device, the vibration mechanism operable, when energized, to vibrate the pad conditioning device for some portion of the time the pad conditioning device is in contact with the polishing pad.

2. The system of claim 1 wherein, the conditioning device comprises a pad conditioning disk.

3. The system of claim 1 wherein, the vibration mechanism comprises a transducer, the transducer coupled to the top portion of the conditioning device.

4. The system of claim 1 wherein, the vibration mechanism comprises a transducer, the transducer mounted within the conditioning device in a recess formed within the interior of the conditioning device.

5. The system of claim 1 wherein, the vibration mechanism comprises a transducer, the transducer mounted within the conditioning device in a recess formed within the interior of the conditioning device such that the transducer mounts in the radial center of the conditioning device.

6. The system of claim 1 further comprising, a rotating, vibrating pad conditioning device operable to rotate and vibrate during pad conditioning, comprising;

a rotatably mounted pad conditioning device;

a rotation motor mounted in a recess within the conditioning device; and an electrical connection operable to connect the motor to an electrical source to provide energy to the rotation motor.

7. The system of claim 1 wherein, the slurry build-up includes slurry glaze on the polishing pad surface, slurry impregnated in the polishing pad surface, and slurry contaminated in polishing pad voids.

8. A system for conditioning a polishing pad in a chemical-mechanical polishing process, comprising:

a high pressure spray device operable to deliver a pressurized substance onto the polishing pad to remove particles from the polishing pad, the high pressure spray device comprising;

a tube formed to include a plurality of delivery holes, the tube having a first open end and a second capped end, the tube operable to receive a pressurized substance;

a pressurized substance operable to flow into the tube and exit through the plurality of delivery holes onto the polishing pad.

9. The system of claim 8, further comprising:

a shroud positioned around the tube, the shroud operable to provide a splash guard to limit the migration of the pressurized substance;

a spacer positioned between the shroud and the tube, the spacer operable to prevent the tube from moving rapidly away from the polishing pad surface due to the force of the substance flowing through the plurality of delivery holes.

10. The system of claim 8 wherein, the plurality of delivery holes formed into the tube to provide a delivery angle θ such that the substance is delivered at the angle θ into the direction the polishing pad rotates.

11. The system of claim 8 wherein, the plurality of delivery holes are offset from the tube bottom centerline to provide a delivery angle θ such that the substance is delivered at the angle θ into the direction the polishing pad rotates.

12. The system of claim 8 wherein, the pressurized substance comprises pressurized deionized water.

13. The system of claim 8 wherein, the tube comprising a double walled tube having an inner tube and an outer tube, wherein the substance flows between the inner tube and outer tube and wherein the plurality of delivery holes penetrate the outer tube.

14. The system of claim 8 wherein, the pressurized substance is pressurized to approximately 100 psi.

15. The system of claim 8 wherein, the pressurized substance is heated to approximately 140 degrees Fahrenheit.

16. A method for conditioning a polishing pad in a chemical-mechanical polishing process, comprising:

contacting a pad conditioning device to the polishing pad while the polishing pad is rotating;

vibrating the pad conditioning device as the pad conditioning device contacts the polishing pad to remove slurry build-up on the polishing pad, thereby enhancing the polishing effectiveness of the polishing pad when polishing a semiconductor device;

delivering a pressurized substance onto the polishing pad to remove particles from the polishing pad.

17. The method of claim 16 wherein vibrating the pad conditioning device further comprises, mounting a transducer to the radial center of the pad conditioning device; and energizing the transducer to vibrate the pad conditioning device.

18. The method of claim 16 further comprising, rotatably mounting the pad conditioning device;

coupling a rotation motor to the pad conditioning device;

connecting the rotation motor to an electrical source through an electrical connection; and energizing the rotation motor to rotate the pad conditioning device.

19. The method of claim 16 wherein delivering a pressurized substance to the polishing pad further comprises;

flowing the pressurized substance in a tube having a plurality of delivery holes;

delivering the pressurized substance at a delivery angle into the rotation of the polishing pad by offsetting the plurality of delivery holes from the tube bottom centerline;

positioning a shroud positioned around the tube to provide a splash guard to limit the migration of the pressurized substance; and positioning a between the shroud and the tube to prevent the tube from moving rapidly away from the polishing pad surface due to the force of the substance flowing through the plurality of delivery holes.

20. The method of claim 16 further comprising, pressurizing a pressurized substance comprising deionized water to approximately 100 psi; and heating the pressurized deionized water to approximately 140 degrees Fahrenheit.

* * * * *